US012714933B2

(12) United States Patent
Kang et al.

(10) Patent No.: US 12,714,933 B2
(45) Date of Patent: Aug. 25, 2026

(54) BALL GOAL-IN GAME MACHINE

(71) Applicant: KOMUSE Co., Ltd., Paju-si (KR)

(72) Inventors: Nam Ho Kang, Gimpo-si (KR); Seong Ho Park, Goyang-si (KR); Ryeol Baek, Goyang-si (KR)

(73) Assignee: KOMUSE CO., LTD., Paju-si (KR)

( * ) Notice: Subject to any disclaimer, the term of this patent is extended or adjusted under 35 U.S.C. 154(b) by 150 days.

(21) Appl. No.: 18/943,150

(22) Filed: Nov. 11, 2024

(65) Prior Publication Data

US 2026/0131225 A1 May 14, 2026

(51) Int. Cl.
*A63F 7/02* (2006.01)

(52) U.S. Cl.
CPC ..... *A63F 7/025* (2013.01)

(58) Field of Classification Search
CPC ..... A63F 7/0005; A63F 7/025; A63F 7/00; A63F 2007/345; A63D 3/02
See application file for complete search history.

(56) References Cited

FOREIGN PATENT DOCUMENTS

KR 20-2012-0004427 U 6/2012

*Primary Examiner* — Dmitry Suhol
(74) *Attorney, Agent, or Firm* — You & IP, LLC

(57) ABSTRACT

Provided is a ball goal-in game machine in which, when a hitter is moved forward and backward using a lever of a hitting device, and a ball on an upward rail part is hit by the hitter, the hit ball moves upward along the upward rail part, moves downward along a downward rail part, enters a game score output part, and enters any one of a plurality of goal-in holes, and at this time, a score corresponding to the goal-in hole that the ball has entered is output on a score display part, and a game score is obtained.

8 Claims, 10 Drawing Sheets

BALL GOAL-IN GAME MACHINE

BACKGROUND

1. Field of the Invention

The present invention relates to a ball insertion game machine, and more particularly, to a ball goal-in game machine in which a ball is hit by a hitting device for the ball to move along an upward rail part and a downward rail part of a game machine main body and enter one of a plurality of goal-in holes of a game score output part configured to output different scores, thereby obtaining a score corresponding to the goal-in hole.

2. Discussion of Related Art

Generally, a game machine is a device allowing a user to win a designated prize according to an outcome of a game, and for the purpose of making the game enjoyable, the game machine is equipped with a prize dispenser for the user to gain a greater sense of accomplishment.

Here, since the outcome of the game is determined according to the user's operating ability, the game machine allows the user, who is enjoying the game, to gain a sense of accomplishment and also win a prize.

Patent Document 1 discloses a conventional ball game device that includes a guide plate having a plate shape, having a pair of sidewalls symmetrical to each other formed at both sides of an upper end, and having crests and valleys formed on upper ends of the sidewalls for any one of the valleys to be set as a goal-in point, stopping rails formed as a pair on front ends of the sidewalls to correspond to the sidewalls and connected to the sidewalls to expose a game ball to the outside of a transparent cover, a return preventing part installed to be able to move upward or downward on an upper surface of the guide plate between the sidewalls and the stopping rails to limit movement of the game ball toward the stopping rails, a first sensor formed close to a rear end of the return preventing part and configured to detect whether the game ball passes and control an operation of the return preventing part, a second sensor formed on a bottom surface between the valleys of the guide plate to determine whether the game ball has succeeded, and a third sensor provided at a rear end of the second sensor and formed on the bottom surface between the valleys of the guide plate to determine whether the game ball has succeeded or failed.

Here, an outer surface of the game ball seated on the stopping rail is gripped with both hands, and in that state, an external force is applied to the game ball to push the game ball forward.

Then, the game ball that was moving along the stopping rail is guided to the upper end of the sidewall of the guide plate and continuously moved forward, and at this time, when the game ball is located in a valley between a crest and another crest, the second sensor detects the game ball and determines that the game has succeeded.

If, at a point in time at which the game ball passes the first sensor due to an operation of pushing the game ball, the return preventing part moves upward, and at this time, the game ball, which has passed the first sensor, moves backward and moves toward the stopping rail, the game ball is blocked by the return preventing part, and the game is determined as having failed.

In addition, when the game ball moves along the sidewall and is located in a valley formed at a tip of the sidewall, the third sensor detects the game ball, and at this time, the third sensor determines that the game has failed or determines that the game has succeeded.

That is, the third sensor may determine that the game has succeeded or failed due to an operation by the user.

Next, when the game ball is caught at the return preventing part or is located in a valley between a crest and another crest, and the game is determined as having succeeded or failed, a ball return part is operated to move a height adjusting part upward, and accordingly, as a front end of the guide plate moves upward, the game ball located in the valley moves toward the stopping rail, and the game ball returns to the stopping rail.

However, in Patent Document 1 described above, there are problems in that a level of interest in the game rapidly decreases due to a simple game method in which an external force is applied to the game ball to place the game ball at a position of a valley between a crest and another crest, there is an inconvenience of having to return the game ball to the stopping rail through the ball return part every time the game has succeeded or failed, it takes a long time to move the guide plate upward or downward and return the game ball through the ball return part, it is difficult to induce competition through game scores due to a simple success method of placing the game ball in a valley, and in particular, in the case of the elderly or children who have weak muscular strength, there is great difficulty in successfully placing the game ball in a valley due to a short moving distance of the game ball, and there is an inconvenience of having to readjust a ball moving distance or use a relatively lightweight game ball, causing a decrease in product reliability.

RELATED ART DOCUMENT (Patent Document 1) KR 20-2012-0004427 U

SUMMARY OF THE INVENTION

The present invention is directed to providing a ball goal-in game machine that has a game machine main body having an upward rail part and a downward rail part extending from the upward rail part formed thereon, has a hitting device installed to form a lever, which is able to move forward and backward, on a front surface of the game machine main body and form a hitter connected to the lever via a link structure, has a ball supplier formed in an upper surface of the game machine main body and installed to be able to move upward or downward and supply a ball to the upward rail part, has a game score output part formed on a rear surface of the game machine main body and having a plurality of goal-in holes formed along an edge to allow the ball moving along the downward rail part to enter one of the goal-in holes, and has score display parts, which are connected to the plurality of goal-in holes and configured to display scores corresponding to the goal-in holes, formed at an upper portion of the game score output part, wherein, when the hitter is moved forward and backward using the lever of the hitting device, and the ball on the upward rail part is hit by the hitter, the hit ball moves upward along the upward rail part, moves downward along the downward rail part, enters the game score output part, and enters any one of the plurality of goal-in holes, and at this time, a score corresponding to the goal-in hole that the ball has entered is output on the score display part, and a game score is obtained.

According to one aspect of the present invention, there is provided a ball goal-in game machine including a game machine main body having an upper surface on which an upward rail part inclined at a predetermined angle from a front toward a rear and a downward rail part extending to be inclined downward from a tip of the upward rail part are formed to guide a ball to move in a straight line along the upward rail part and the downward rail part; a hitting device including a lever, which is installed to be able to move forward and backward, formed on a front surface of the game machine main body and a hitter connected to the lever, located at a front end of the upward rail part of the game machine main body, connected to the lever via a link structure, and moved forward and backward by the lever to hit the ball; a ball supplier installed to be buried in an upper surface of the game machine main body to be close to the upward rail part, moved upward or downward to be exposed to the upper surface of the game machine main body, and configured to supply the ball to the upward rail part; a game score output part rotatably installed on a rear surface of the game machine main body and having a plurality of goal-in holes formed to be spaced apart at predetermined intervals in an annular shape along an edge to allow the ball moving downward along the downward rail part to enter one of the goal-in holes and output different scores according to the goal-in hole that the ball has entered; and a plurality of score display parts installed to be fixed to the rear surface of the game machine main body to be located at an upper portion of the game score output part and connected to the game score output part to display a score corresponding to the goal-in hole that the ball has entered.

In the ball goal-in game machine according to the present invention, the game machine main body may further include a payment part installed at one side of the front surface to allow a game play fee to be paid; a ticket output part installed at the other side of the front surface to allow a ticket to be output; and a ticket output display part formed at one side of the upper surface and configured to compute the scores displayed on the score display parts and display the number of tickets that are able to be output.

In the ball goal-in game machine according to the present invention, the game machine main body may further include an upward rail sensor installed on an upper surface of the front end of the upward rail part to detect whether the ball passes, output a sound effect through a speaker, and detect whether the ball enters the upward rail part; and a downward rail sensor installed on an upper surface of the downward rail part to detect whether the ball passes the downward rail part.

In the ball goal-in game machine according to the present invention, the ball supplier may include an upward/downward mover having a rack gear formed to stand upright on one side surface and a discharge hole, which is open toward the upward rail part, formed in a side surface orthogonal to the rack gear and configured to move upward or downward to be exposed to the upper surface of the game machine main body and drop and supply the ball to the upward rail part; and a driving motor buried in the upper surface of the game machine main body, provided at one side of the upward/downward mover, and having a pinion gear formed to be engaged with and coupled to the rack gear to rotate the pinion gear in place and force the rack gear to move upward or downward in a direction in which it stands upright.

In the ball goal-in game machine according to the present invention, the upward/downward mover may further have an inclined bottom surface formed to be inclined downward from a bottom surface of the discharge hole toward the upward rail part to guide the ball to roll down toward the upward rail part.

In the ball goal-in game machine according to the present invention, the game score output part may include a housing formed in a hollow shape having an open front, formed to be inclined at a predetermined angle on the rear surface of the game machine main body to correspond to a direction in which the ball advances, and having a return hole formed in a front surface on a rotation path of the goal-in hole to coincide with the goal-in hole and guide discharge of the ball that has entered the goal-in hole; a rotary plate rotatably installed on an inner front surface of the housing and having the plurality of goal-in holes, which are configured to coincide with the return hole, formed along an edge of a front surface and a rotating shaft formed on a rear surface to be exposed to a rear of the housing; an encoder connected to a tip of the rotating shaft of the rotary plate and configured to rotate to correspond to the rotary plate and identify a position of each of the goal-in holes; a ball detection sensor installed to be fixed around an edge of a rear surface of the return hole of the housing and configured to detect whether the ball is discharged through the return hole; a rotary motor installed to be fixed to a rear surface of the housing and configured to be coupled to be engaged with the rotating shaft and rotate the rotary plate in a forward direction or a reverse direction; and a controller electrically connected to the encoder and the ball detection sensor and configured to receive signals from the encoder and the ball detection sensor and output a score of the ball, which has entered the goal-in hole, on the score display part.

In the ball goal-in game machine according to the present invention, the housing may further have a ball guide frame formed in an arch shape on an inner peripheral surface of a lower end to guide the ball, which has entered the housing, to be located at a central portion of the lower end of the housing, and the goal-in holes of the rotary plate may further include basic score holes configured to allow entry of the ball by a lower end contact point, among contact points differentiated in an up-down direction and a left-right direction by virtual orthogonal lines, being formed relatively lower than a height of an upper end of the ball guide frame; and bonus holes that are formed to be relatively less in number than the basic score holes, formed to have different diameters, and configured to allow entry of the ball by a lower end contact point, among contact points differentiated in the up-down direction and the left-right direction by virtual orthogonal lines, being formed relatively higher than the height of the upper end of the ball guide frame.

In the ball goal-in game machine according to the present invention, the controller may receive a detection signal of the ball from the ball detection sensor, also receive a position signal of the goal-in hole coinciding with the return hole among the plurality of goal-in holes from the encoder, and output a score that corresponds to the goal-in hole coinciding with the return hole among the plurality of goal-in holes to the score display part.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, embodiments of the present invention will be described in more detail with reference to the accompanying drawings.

Figure 1:
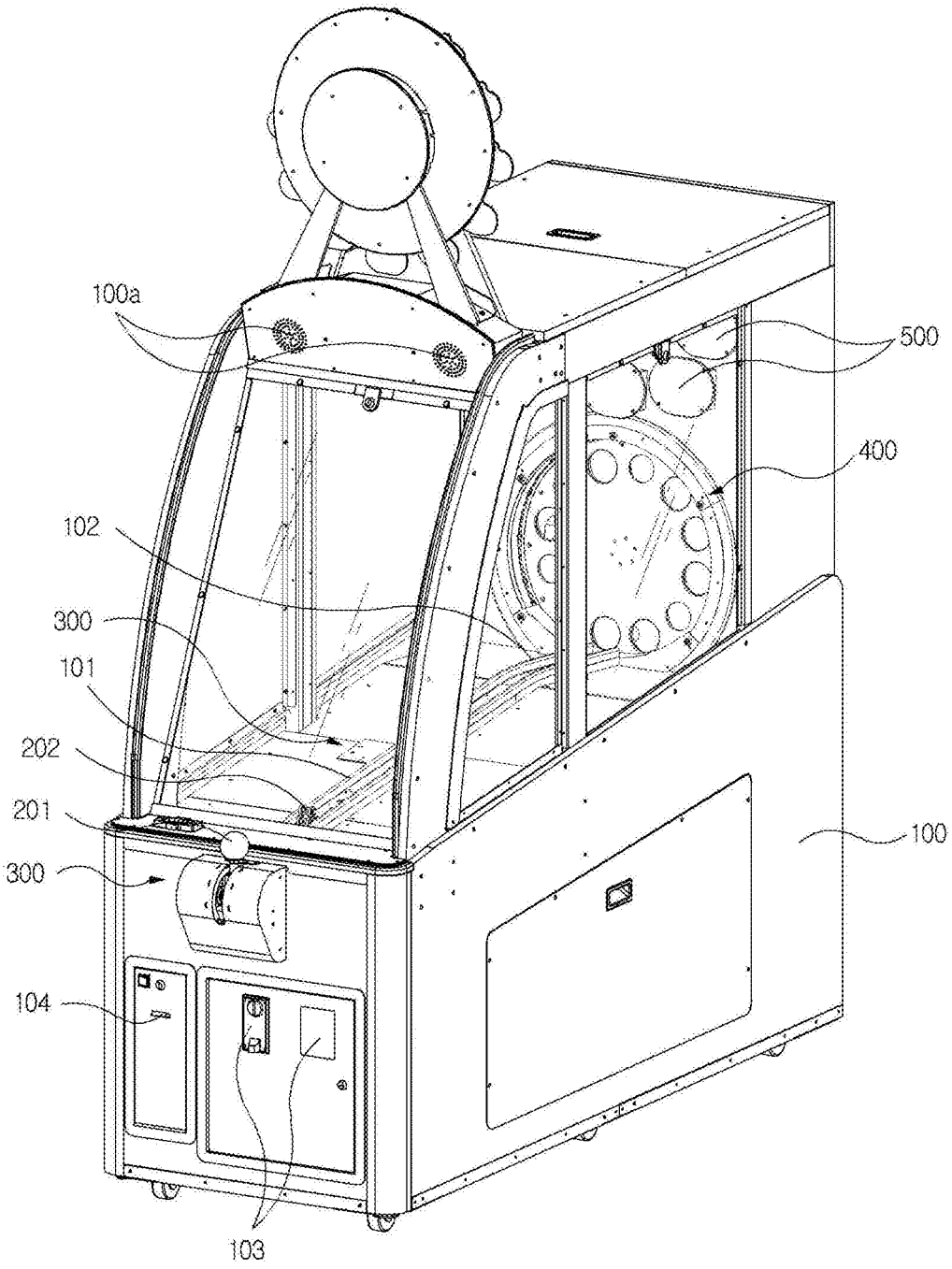
FIG. 1 is a perspective view illustrating a ball goal-in game machine according to the present invention.
Figure 2:
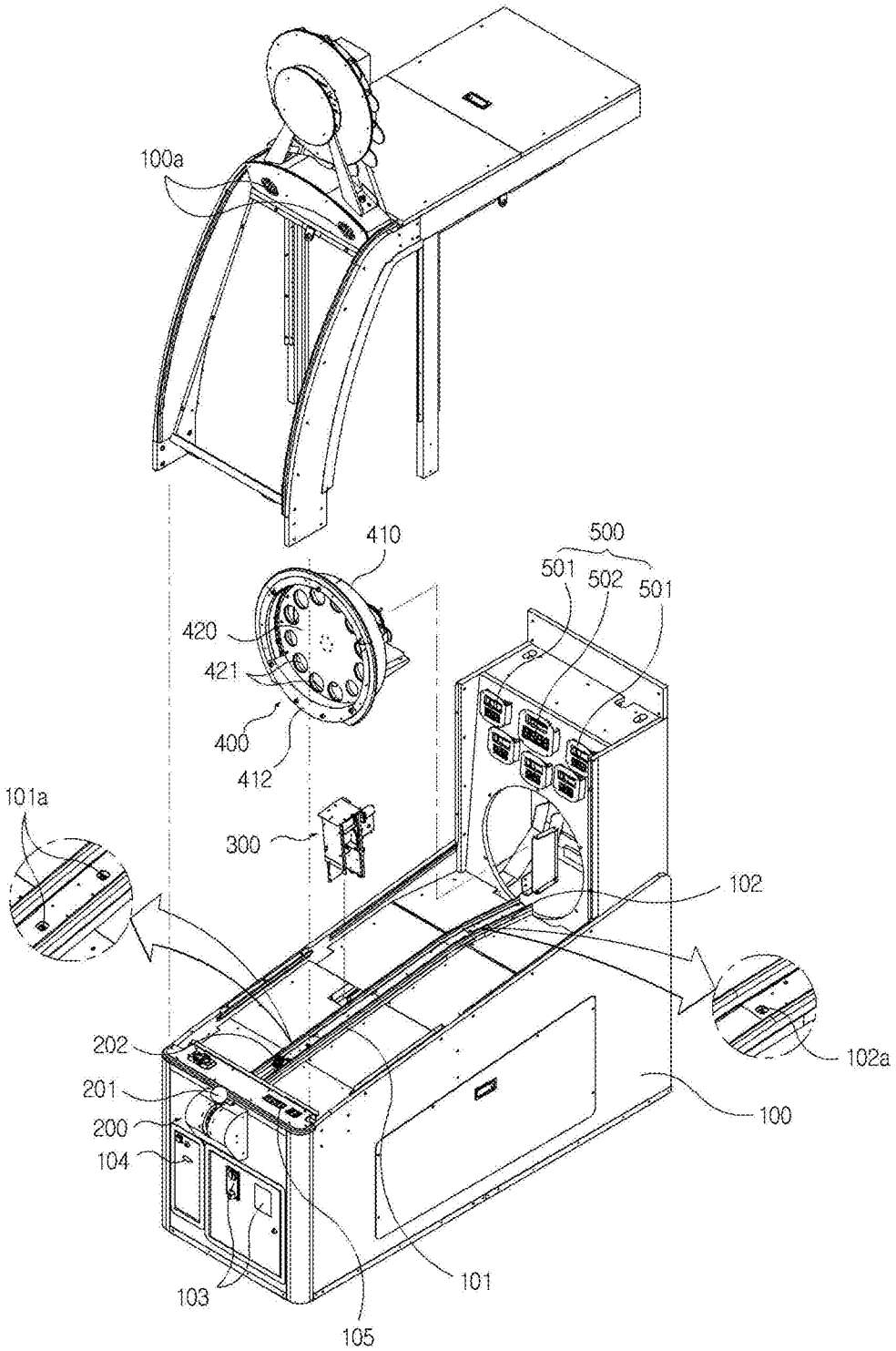
FIG. 2 is an exploded perspective view of FIG. 1.
Figure 3:
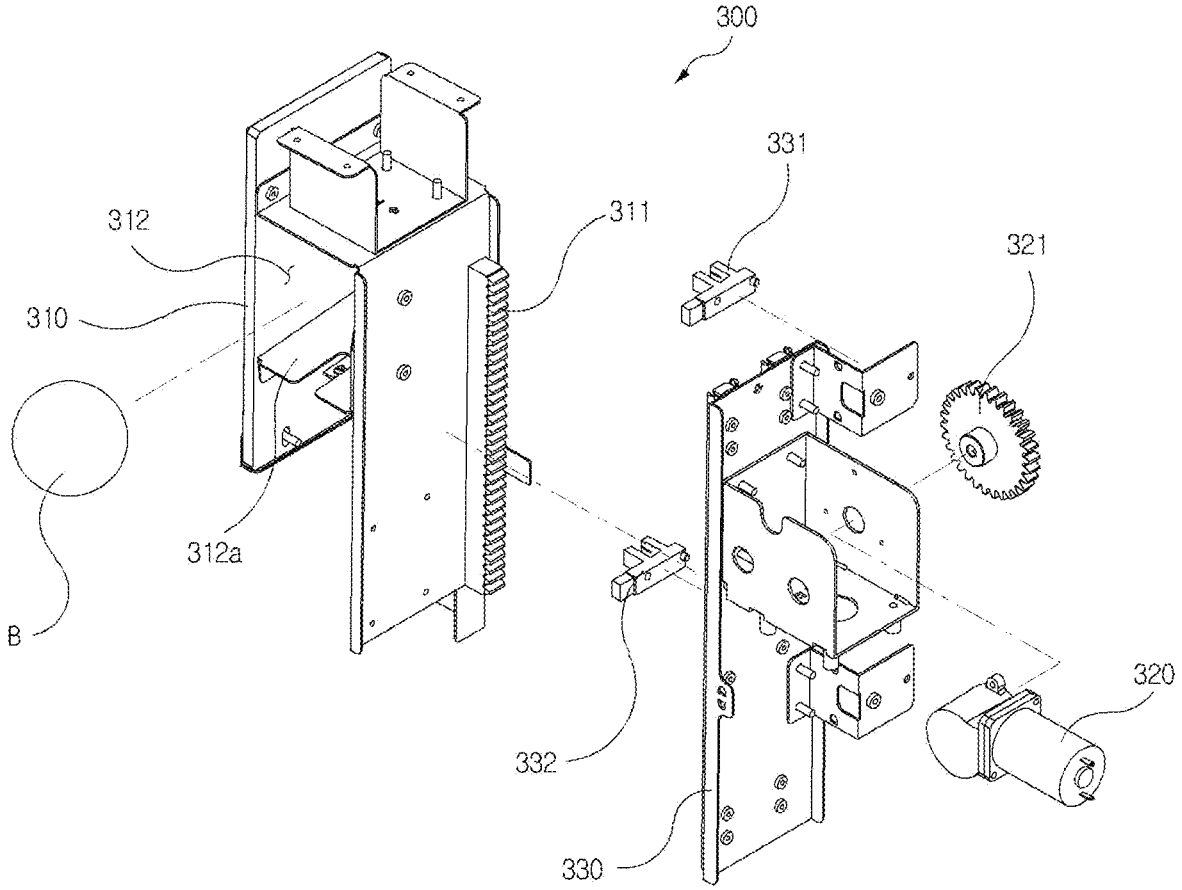
FIG. 3 is an exploded perspective view of a ball supplier of the ball goal-in game machine according to the present invention.
Figure 4:
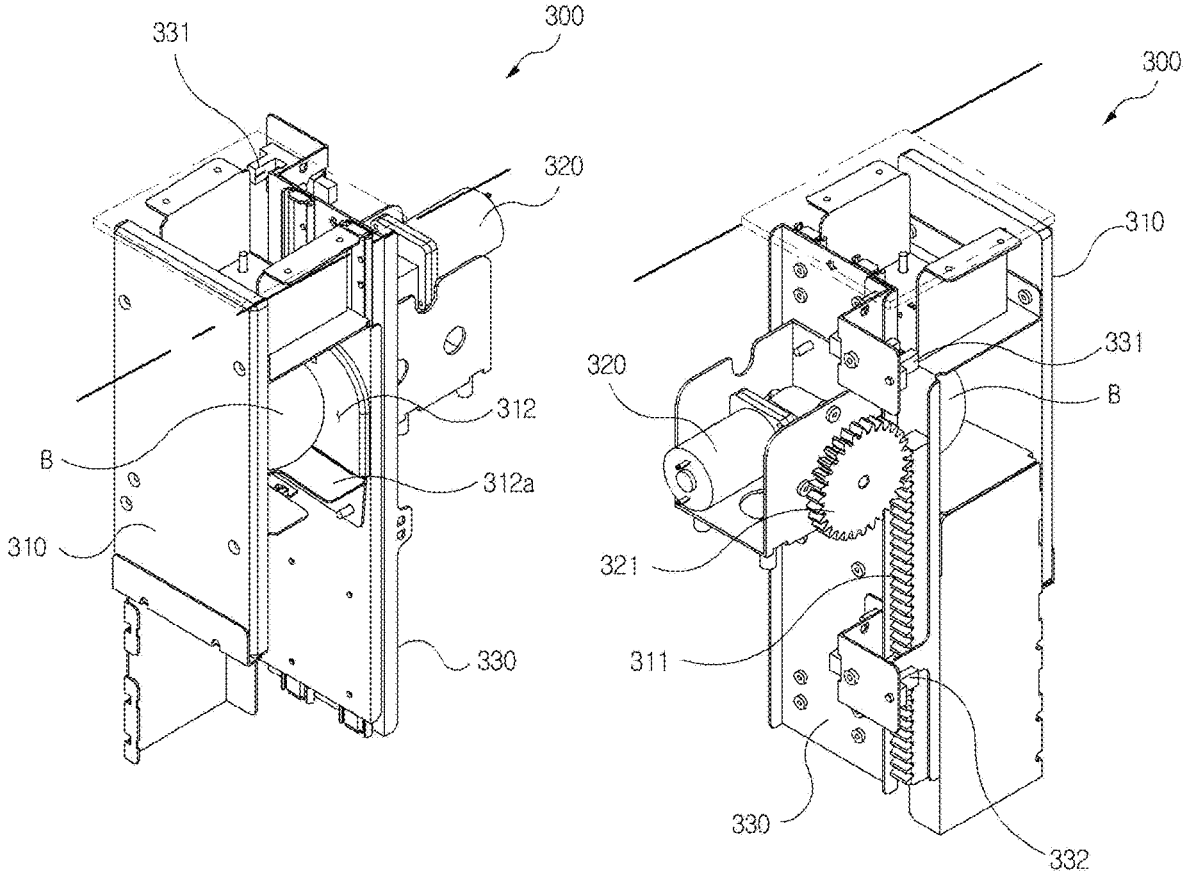
FIG. 4 is a perspective view illustrating a state in which the ball supplier of the ball goal-in game machine according to the present invention is buried in a game machine main body.
Figure 5:
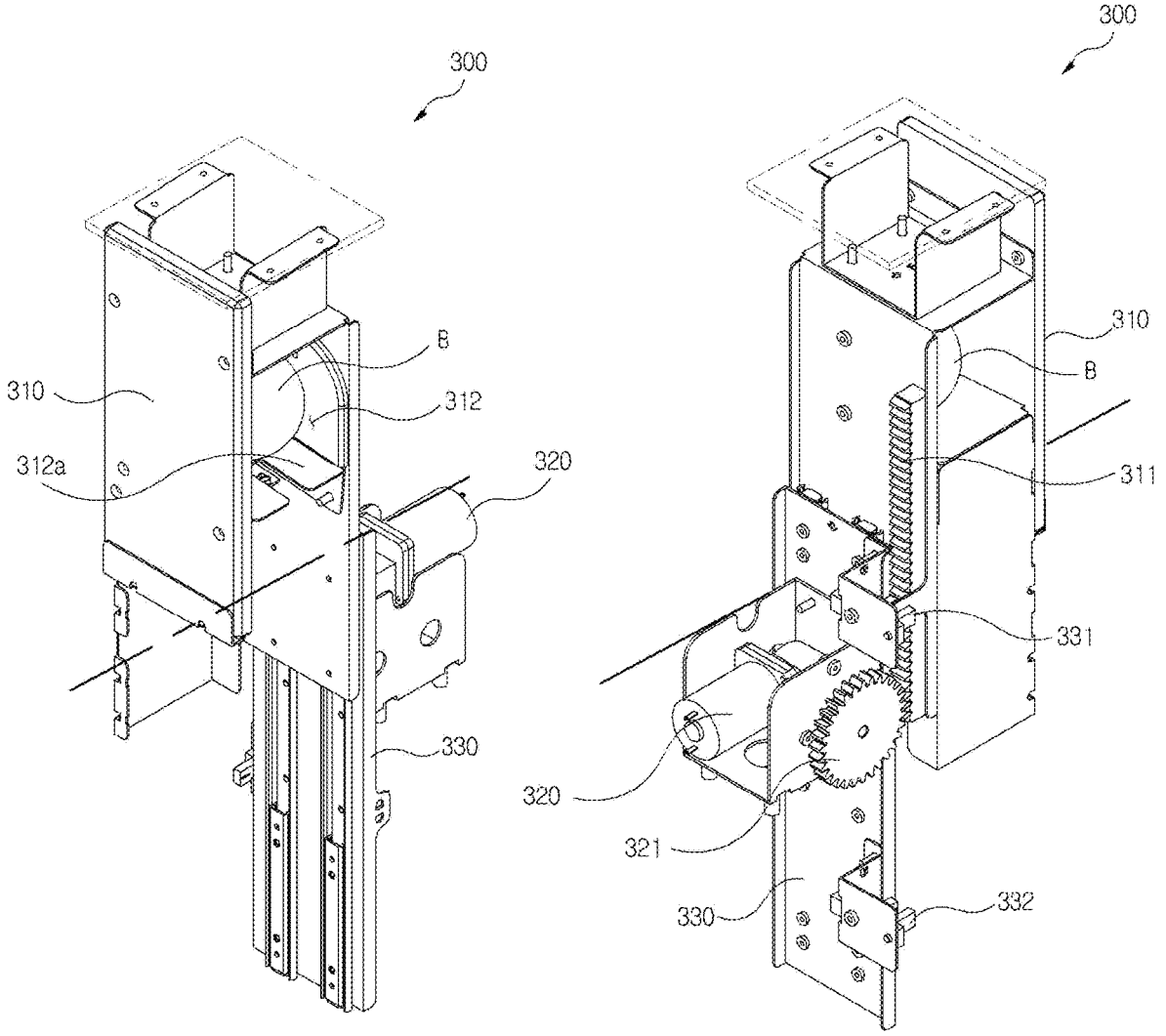
FIG. 5 is a perspective view illustrating a state in which the ball supplier of the ball goal-in game machine according to the present invention is exposed to an upper portion of the game machine main body.
Figure 6:
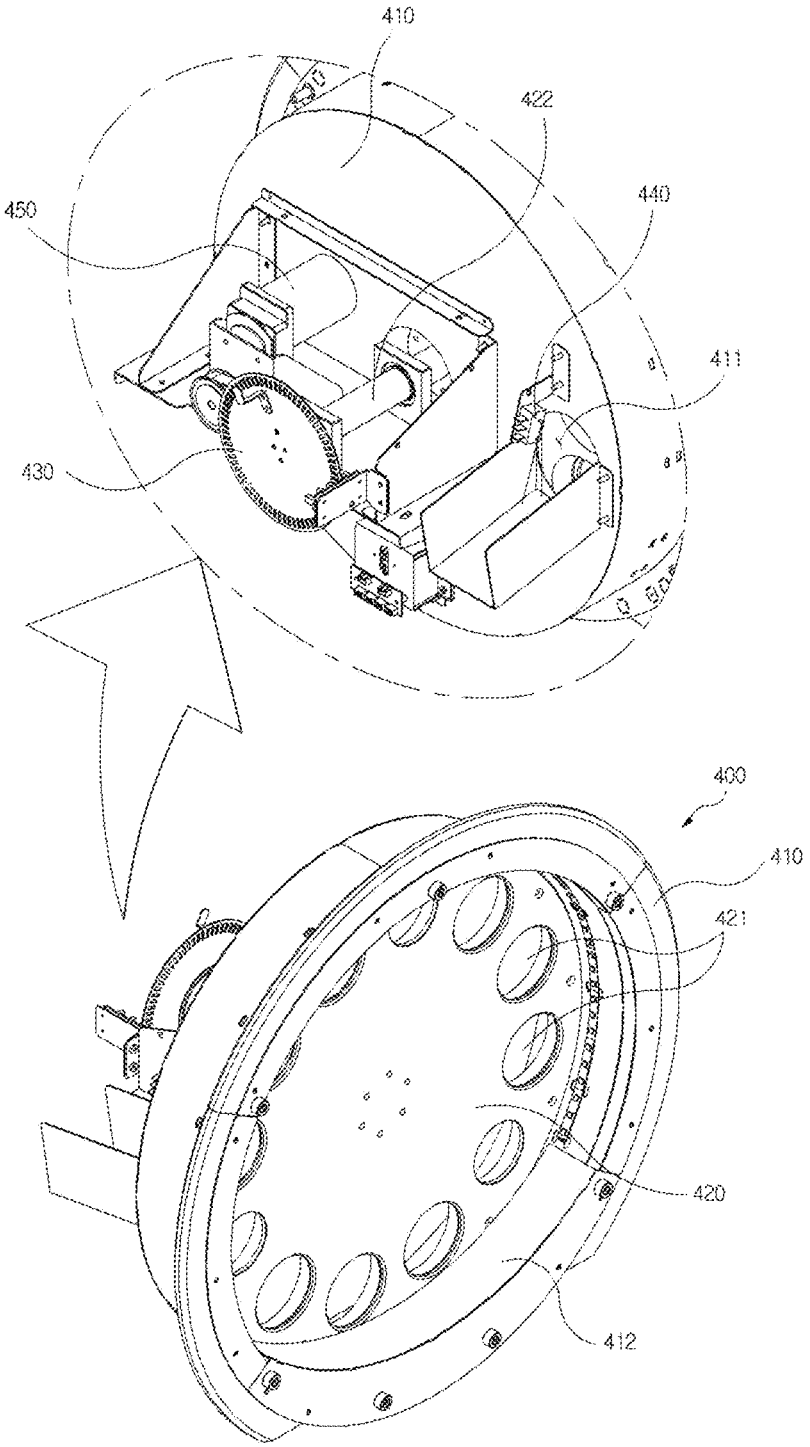
FIG. 6 is a perspective view illustrating a game score output part of the ball goal-in game machine according to the present invention.
Figure 7:
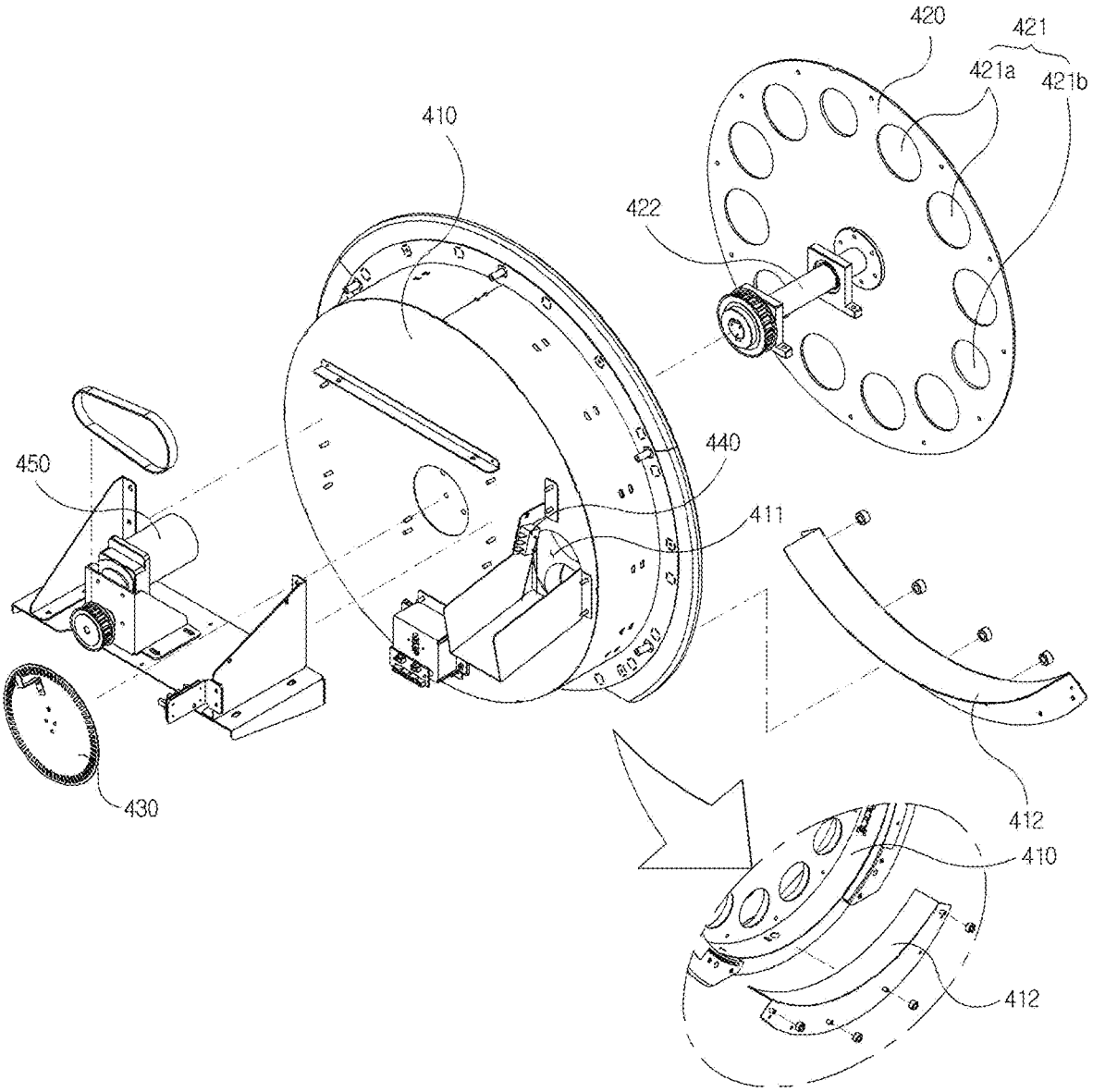
FIG. 7 is an exploded perspective view of FIG. 6.
Figure 8:
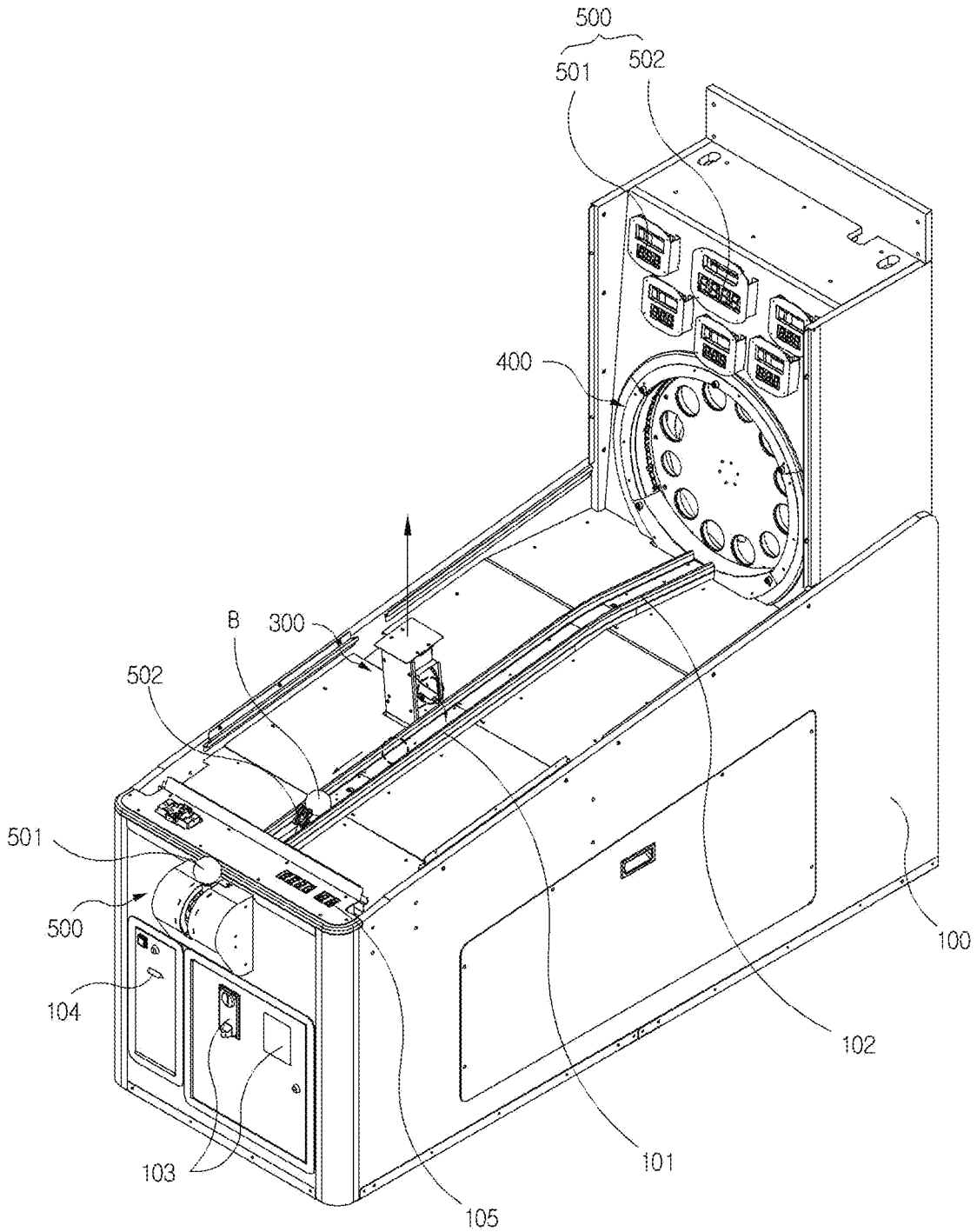
FIG. 8 is a perspective view illustrating a state in which a ball is supplied to an upward rail part through the ball supplier of the ball goal-in game machine according to the present invention.
Figure 9:
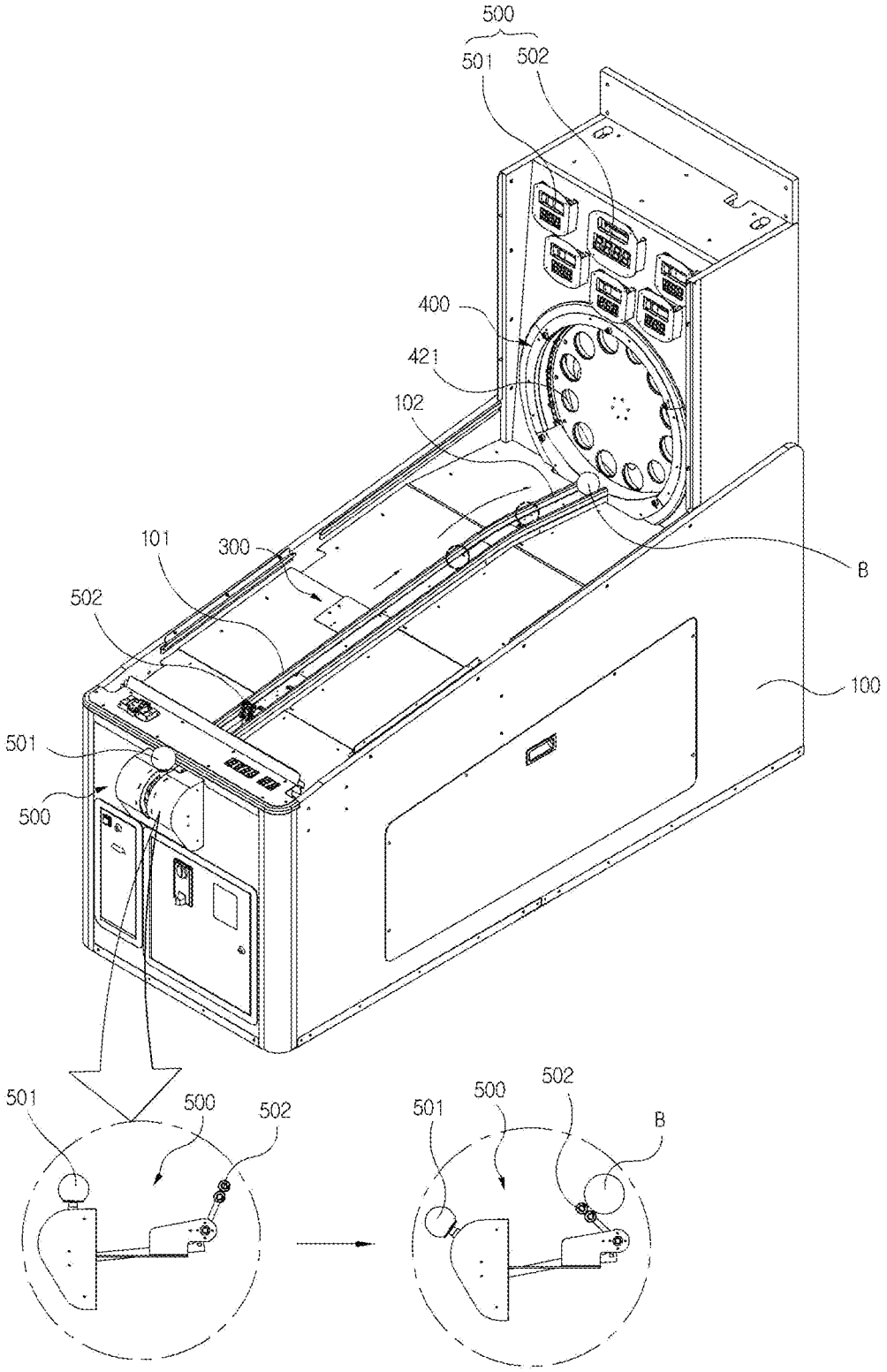
FIG. 9 is a perspective view illustrating a state in which a ball enters the game score output part of the ball goal-in game machine according to the present invention.
Figure 10:
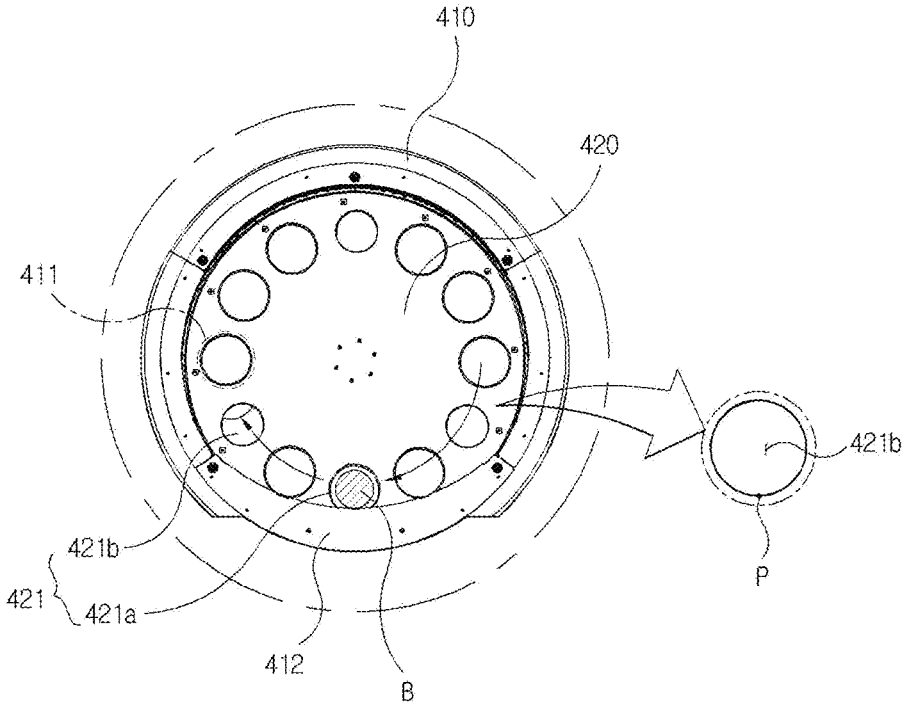
FIG. 10 is a front view illustrating an operation state of the game score output part of the ball goal-in game machine according to the present invention.
Figure 10:
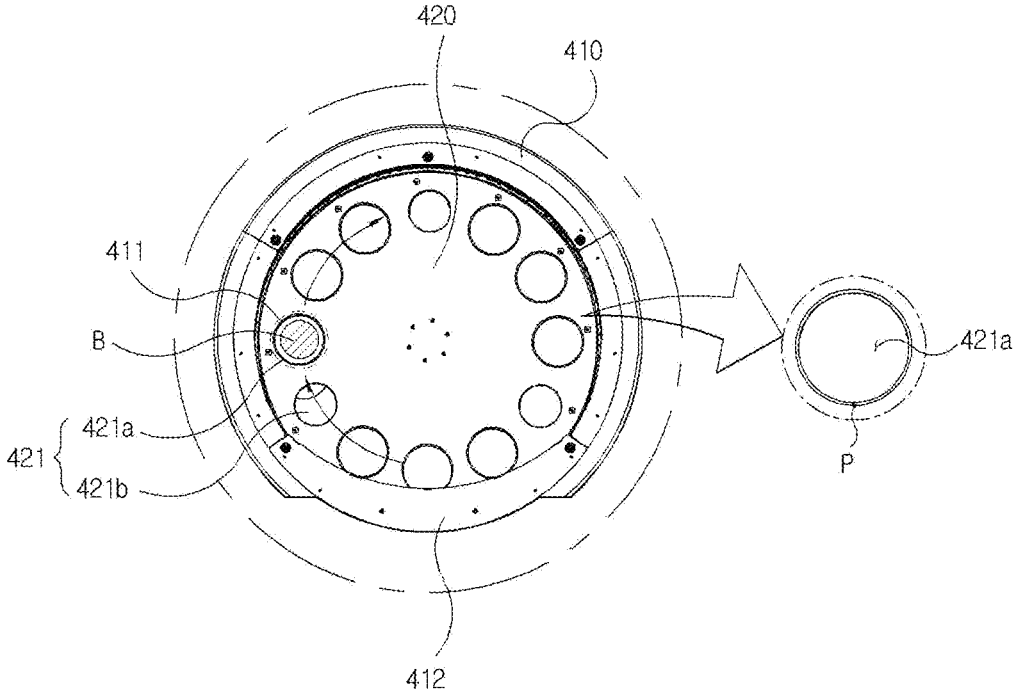

Referring to FIGS. 1 to 10, a game machine main body 100 has an upper surface on which an upward rail part 101 inclined at a predetermined angle from a front toward a rear and a downward rail part 102 extending to be inclined downward from a tip of the upward rail part 101 are formed to guide a ball B to move in a straight line along the upward rail part 101 and the downward rail part 102.

The game machine main body 100 has four surfaces finished with a see-through barrier (not illustrated), and the ball B seated on the upward rail part 101 and the downward rail part 102 is prevented from being touched.

The game machine main body 100 has light emitting diodes (LEDs) (not illustrated) mounted on the upward rail part 101 and the downward rail part 102 so that light is turned on along the upward rail part 101 and the downward rail part 102.

The game machine main body 100 has the upper surface formed to be inclined upward or downward to correspond to the upward rail part 101 and the downward rail part 102.

The game machine main body 100 further includes a payment part 103 installed at one side of a front surface to allow a game play fee to be paid, a ticket output part 104 installed at the other side of the front surface to allow a ticket to be output, and a ticket output display part 105 formed on one side of an upper surface and configured to compute a score displayed on a score display part 500 and display the number of tickets that are able to be output.

The payment part 103 is formed to enable payment via cash or credit card and allows a user to pay a game play fee.

The ticket output part 104 outputs tickets (not illustrated) in number proportional to the number displayed on the ticket output display part 105.

The ticket output display part 105 displays the number of tickets that can be obtained through the ticket output part 104.

The game machine main body 100 further includes an upward rail sensor 101*a* installed on an upper surface of a front end of the upward rail part 101 to detect whether the ball B passes, output a sound effect through a speaker 100*a*, and detect whether the ball B enters the upward rail part 101 and a downward rail sensor 102*a* installed on an upper surface of the downward rail part 102 to detect whether the ball B passes the downward rail part 102.

The upward rail sensor 101*a* detects whether the ball B, which moves upward toward the downward rail part 102 due to a hitting device 200, passes.

The downward rail sensor 102*a* detects whether the ball B, which has passed the upward rail sensor 101*a*, passes and determines whether the ball B enters a game score output part 400.

The downward rail sensor 102*a* determines that the ball B has returned to its original position when the ball B is not detected after passing the upward rail sensor 101*a* and then re-detected by the upward rail sensor 101*a*.

The downward rail sensor 102*a* determines that the ball B has deviated from the downward rail part 102 and the upward rail part 101 when the ball B that has passed the upward rail sensor 101*a* is not detected and the ball B is not detected by the upward rail sensor 101*a* for more than a predetermined amount of time.

The speaker 100*a* may be installed on any one of a front surface, side surfaces, or a rear surface of the game machine main body 100 or installed on the front surface, the side surfaces, and the rear surface to output a sound effect.

The hitting device 200 includes a lever 201, which is installed to be able to move forward and backward, formed on the front surface of the game machine main body 100 and a hitter 202 connected to the lever 201, located at a front end of the upward rail part 101 of the game machine main body 100, connected to the lever 201 via a link structure, and moved forward and backward by the lever 201 to hit the ball B.

The hitting device 200 hits the ball B and forces the ball B to move in a straight line along the upward rail part 101 and the downward rail part 102.

The lever 201 is gripped by a user and then forced to move backward to move the hitter 202 backward.

A distance at which the lever 201 moves backward is adjusted by a pulling force of the user to adjust a distance at which the hitter 202 moves backward.

The hitter 202 rotates forward and hits the ball B when the pulling force on the lever 201 is released.

A ball supplier 300 is installed to be buried in an upper surface of the game machine main body 100 to be close to the upward rail part 101, is moved upward or downward to be exposed to the upper surface of the game machine main body 100, and supplies the ball B to the upward rail part 101.

The ball supplier 300 is moved upward or downward to supply the ball B to the upward rail part 101 when the ball B, which has entered a goal-in hole 421 of the game score output part 400, is discharged through a return hole 411 of the game score output part 400.

The ball supplier 300 is installed to be buried in an inclined upper surface of the game machine main body 100, which corresponds to the upward rail part 101, and supplies the ball B to the upward rail part 101.

The ball supplier 300 includes an upward/downward mover 310 having a rack gear 311 formed to stand upright on one side surface and a discharge hole 312, which is open toward the upward rail part 101, formed in a side surface orthogonal to the rack gear 311 and configured to move upward or downward to be exposed to the upper surface of the game machine main body 100 and drop and supply the ball B to the upward rail part 101, and a driving motor 320 buried in the upper surface of the game machine main body 100, provided at one side of the upward/downward mover 310, and having a pinion gear 321 formed to be engaged with and coupled to the rack gear 311 to rotate the pinion gear 321 in place and force the rack gear 311 to move upward or downward in a direction in which it stands upright.

The upward/downward mover 310 that has moved downward is buried in the game machine main body 100 and then moves upward and is exposed to the upper surface of the game machine main body 100.

The upward/downward mover 310 is installed to be buried in the game machine main body 100 and is vertically moved upward or downward along a fixing frame 330 fixing the driving motor 320.

The fixing frame 330 maintains a state in which it is installed to be fixed in the game machine main body 100.

The fixing frame 330 includes an upper end sensor 331 disposed at one side of an upper end to detect upward movement of a lower end of the upward/downward mover 310 and limit vertical movement of the upward/downward mover 310 upward at a predetermined distance or more, and a lower end sensor 332 disposed at one side of a lower end to detect downward movement of an upper end of the upward/downward mover 310 and limit vertical movement of the upward/downward mover 310 downward at a predetermined distance or more.

The upward/downward mover 310 is exposed to the upper surface of the game machine main body 100 due to the rack gear 311 that, due to the pinion gear 321, moves upward or downward in the direction in which it stands upright.

The upward/downward mover 310 drops and supplies the ball B onto the upward rail part 101 through the discharge hole 312.

The upward/downward mover 310 further has an inclined bottom surface 312*a* formed to be inclined downward from a bottom surface of the discharge hole 312 toward the upward rail part 101 to guide the ball B to roll down toward the upward rail part 101.

The inclined bottom surface 312*a* guides the ball B to roll down toward the upward rail part 101 when the upward/downward mover 310 is exposed to the upper surface of the game machine main body 100.

The driving motor 320 rotates at a predetermined speed and rotates the pinion gear 321 engaged with and coupled to the rack gear 311.

The driving motor 320 rotates the pinion gear 321 in a forward direction or a reverse direction so that the rack gear 311 moves upward or downward.

The game score output part 400 is rotatably installed on the rear surface of the game machine main body 100 and has a plurality of goal-in holes 421 formed to be spaced apart at predetermined intervals in an annular shape along an edge to allow the ball B moving downward along the downward rail part 102 to enter one of the goal-in holes 421 and output different scores according to the goal-in hole 421 that the ball B has entered.

The game score output part 400 rotates at a predetermined speed and has the plurality of goal-in holes 421 sequentially located at a tip of the downward rail part 102.

The game score output part 400 outputs a score that corresponds to the goal-in hole 421 that the ball B has entered to the score display part 500.

The game score output part 400 includes a housing 410 formed in a hollow shape having an open front, formed to be inclined at a predetermined angle on the rear surface of the game machine main body 100 to correspond to a direction in which the ball B advances, and having the return hole 411 formed in a front surface on a rotation path of the goal-in hole 421 to coincide with the goal-in hole 421 and guide discharge of the ball B that has entered the goal-in hole 421, a rotary plate 420 rotatably installed on an inner front surface of the housing 410 and having the plurality of goal-in holes 421, which are configured to coincide with the return hole 411, formed along an edge of a front surface and a rotating shaft 422 formed on a rear surface to be exposed to a rear of the housing 410, an encoder 430 connected to a tip of the rotating shaft 422 of the rotary plate 420 and configured to rotate to correspond to the rotary plate 420 and identify a position of each of the goal-in holes 421, a ball detection sensor 440 installed to be fixed around an edge of a rear surface of the return hole 411 of the housing 410 and configured to detect whether the ball B is discharged through the return hole 411, a rotary motor 450 installed to be fixed to a rear surface of the housing 410 and configured to be coupled to be engaged with the rotating shaft 422 and rotate the rotary plate 420 in a forward direction or a reverse direction, and a controller 460 electrically connected to the encoder 430 and the ball detection sensor 440 and configured to receive a signal from the encoder 430 and the ball detection sensor 440 and output a score of the ball B, which has entered the goal-in hole 421, on the score display part 500.

The housing 410 is installed to be fixed to an inner rear surface of the game machine main body 100 and supports rotation of the rotary plate 420.

The housing 410 is formed to be inclined at a predetermined angle so that due to its own weight, the ball B maintains a state in which it is in close contact with a front surface of the rotary plate 420.

In the housing 410, a diameter of the return hole 411 is formed to be proportional to or relatively greater than a diameter of the goal-in hole 421 to allow discharge of the ball B that has entered the goal-in hole 421.

The housing 410 further has a ball guide frame 412 formed in an arch shape on an inner peripheral surface of a lower end to guide the ball B, which has entered the housing 410, to be located at a central portion of the lower end of the housing 410.

The ball guide frame 412 guides the ball B, which has collided with the rotary plate 420, to be located at the central portion of the lower end of the housing 410 and induces the ball B to enter the goal-in hole 421 that coincides with the tip of the downward rail part 102.

The rotary plate 420 rotates in a predetermined direction in the housing 410 and allows the plurality of goal-in holes 421 to sequentially coincide with the tip of the downward rail part 102 for a predetermined amount of time and then be deviated from the tip of the downward rail part 102.

The rotary plate 420 is formed to correspond to an angle of inclination of the housing 410 and allows the ball B, which is in close contact with the front surface of the rotary plate 420 due to its own weight, to enter the goal-in hole 421.

The goal-in holes 421 of the rotary plate 420 further include basic score holes 421*a* configured to allow entry of the ball B by a lower end contact point P, among contact points differentiated in an up-down direction and a left-right direction by virtual orthogonal lines, being formed relatively lower than a height of an upper end of the ball guide frame 412, and bonus holes 421*b* that are formed to be relatively less in number than the basic score holes 421*a*, formed to have different diameters, and configured to allow entry of the ball B by a lower end contact point P, among contact points differentiated in the up-down direction and the left-right direction by virtual orthogonal lines, being formed relatively higher than the height of the upper end of the ball guide frame 412.

The basic score holes 421*a* are differentiated by color bands formed along edges thereof and output different scores.

The basic score holes 421*a* may output a relatively lower score than the bonus holes 421*b*.

The bonus holes 421*b* may output a score that is at least two times greater than a score output by the basic score holes 421*a* or may output relatively more predetermined scores than the basic score holes 421*a*.

The bonus holes 421*b* may be located between the basic score holes 421*a*.

The encoder 430 identifies the positions of the basic score holes 421*a* and the bonus holes 421*b* of the goal-in holes 421 and transmits a signal of the position of the basic score hole 421*a* or the bonus hole 421*b* that the ball B has entered to the controller 460.

The ball detection sensor 440 detects whether the ball B is discharged through the return hole 411 and outputs a signal to the controller 460.

The rotary motor 450 rotates the rotary plate 420 in the forward direction or the reverse direction so that the goal-in holes 421 sequentially coincide with the tip of the downward rail part 102.

The controller 460 receives a signal from the ball detection sensor 440, also receives a position signal of the goal-in hole 421 located to coincide with the return hole 411 from the encoder 430, and outputs a score that corresponds to the goal-in hole 421 to the score display part 500.

The controller 460 receives a detection signal of the ball B from the ball detection sensor 440, also receives a position signal of the goal-in hole 421 coinciding with the return hole 411 among the plurality of goal-in holes 421 from the encoder 430, and outputs a score that corresponds to the goal-in hole 421 coinciding with the return hole 411 among the plurality of goal-in holes 421 to the score display part 500.

The score display part 500 is provided as a plurality of score display parts 500 that are installed to be fixed to the rear surface of the game machine main body 100 to be located at an upper portion of the game score output part 400 and are connected to the game score output part 400 and display scores that correspond to the goal-in holes 421 that the ball B has entered.

The score display part 500 is provided as the plurality of score display parts 500 to display scores obtained by the ball B entering the basic score holes 421*a* and the bonus holes 421*b* of the goal-in holes 421.

The score display part 500 receives a signal from the controller 460 and displays a score corresponding to the basic score hole 421*a* or a score corresponding to the bonus hole 421*b*.

The ball goal-in game machine according to the present invention that is configured as described above is used as follows.

A case in which the rotary plate 420 of the game score output part 400 keeps rotating at all times will be described as an example below.

First, when a game play fee is paid via cash or credit card through the payment part 103 of the game machine main body 100, the upward/downward mover 310 of the ball supplier 300 is exposed to the upper surface of the game machine main body 100 and supplies the ball B to the upward rail part 101.

Here, when the game play fee is paid through the payment part 103, the driving motor 320 of the ball supplier 300 rotates and rotates the pinion gear 321, and at this time, the rack gear 311 of the upward/downward mover 310, which is engaged with and coupled to the pinion gear 321, moves upward and causes the upward/downward mover 310 to be exposed to the upper surface of the game machine main body 100.

Then, as the upward/downward mover 310 is exposed to the upper surface of the game machine main body 100, the ball B accommodated in the upward/downward mover 310 is guided to the inclined bottom surface 312*a* in the discharge hole 312, and the ball B is dropped and discharged toward the discharge hole 312.

At this time, the upward/downward mover 310 vertically moves upward or downward along the fixing frame 330 fixed to be buried in the game machine main body 100 and causes the discharge hole 312 to be exposed to the upper surface of the game machine main body 100.

Then, as the upward/downward mover 310 moves upward along the fixing frame 330, a lower end of the upward/downward mover 310 reaches the upper end sensor 331 of the fixing frame 330, and at this time, the upper end sensor 331 limits upward movement of the upward/downward mover 310, and the upward movement of the upward/downward mover 310 is limited upward at a predetermined distance or more.

Conversely, as the upward/downward mover 310 moves downward along the fixing frame 330, an upper end of the upward/downward mover 310 reaches the lower end sensor 332 of the fixing frame 330, and at this time, the lower end sensor 332 limits downward movement of the upward/downward mover 310, and the downward movement of the upward/downward mover 310 is limited downward at a predetermined distance or more.

At this time, the ball B that is dropped and discharged through the discharge hole 312 is supplied onto the upward rail part 101 and then moved toward the hitting device 200 along the upward rail part 101.

Then, the ball B moves along the upward rail part 101 and comes into contact with the hitter 202 of the hitting device 200, and at this time, a user grips the lever 201 of the hitting device 200 and moves the lever 201 backward.

Here, in order to be proportional to the distance at which the lever 201 moves backward, the hitter 202 connected to the lever 201 via a link structure is rotated backward to correspond to the lever 201 while supporting the ball B, and then when backward movement of the lever 201 is released, the hitter 202 returns to its original position and hits the ball B forward.

Next, the ball B hit by the hitter 202 moves upward toward the game score output part 400 along the upward rail part 101 and then, due to its own weight, moves downward along the downward rail part 102.

Here, in a state in which the ball B has reached a tip of the upward rail part 101, the ball B moving upward along the upward rail part 101 moves over the upward rail part 101 and moves along the downward rail part 102.

At this time, when the ball B is detected by the upward rail sensor 101*a* due to the ball B moving upward along the upward rail part 101, the upward rail sensor 101*a* outputs a sound effect through the speaker 100*a*, and then, the downward rail sensor 102*a* detects the ball B moving downward along the downward rail part 102 and determines that the ball B has normally entered toward the game score output part 400.

Then, the ball B moving downward along the downward rail part 102 enters the housing 410 of the game score output part 400, and at this time, the ball B enters the goal-in hole 421 of the rotary plate 420 that coincides with the tip of the downward rail part 102.

In particular, in a state in which the rotating shaft 422 of the rotary plate 420 is coupled to be engaged with the rotary motor 450, as the rotary plate 420 receives a rotary force of the rotary motor 450 and rotates in the forward direction or the reverse direction, the plurality of goal-in holes 421 continuously rotate to sequentially coincide with the downward rail part 102.

Here, the housing 410 and the rotary plate 420 remain inclined at a predetermined angle, and the ball B that has entered the housing 410 remain placed inside the goal-in hole 421 of the rotary plate 420 due to its own weight.

Then, the ball B that has entered the goal-in hole 421 is rotated by the rotary plate 420 and reaches the return hole 411 of the housing 410, and at this time, at the moment the goal-in hole 421 coincides with the return hole 411, the ball B that has entered the goal-in hole 421 is discharged through the return hole 411.

Here, as the ball B is discharged through the return hole 411, the ball detection sensor 440 detects the discharge of the ball B and transmits a signal to the controller 460, and simultaneously, the encoder 430 identifies the position of the goal-in hole 421 coinciding with the return hole 411 and transmits a signal to the controller 460, and at this time, the controller 460 outputs a score corresponding to the goal-in hole 421 to the score display part 500.

At this time, the goal-in hole 421 is rotated by the rotary plate 420 and coincides with the return hole 411 for a predetermined amount of time, and then is continuously rotated by the rotary plate 420 and is deviated to be misaligned with the return hole 411.

Then, the score corresponding to the goal-in hole 421 that the ball B has entered is output through the score display part 500, and at this time, the score displayed on the score display part 500 is computed, and the number of tickets that can be obtained is displayed on the ticket output display part 105.

Here, the goal-in holes 421 are classified into the basic score holes 421*a* and the bonus holes 421*b*, the basic score holes 421*a* are formed to output different scores, and scores that correspond to different basic score holes 421*a* that the ball B enters are output to the score display parts 500.

On the other hand, the bonus holes 421*b* are able to obtain a relatively higher score than the basic score holes 421*a*, and when the bonus hole 421*b* that the ball B has entered coincides with the return hole 411, the controller 460 outputs a score corresponding to the bonus hole 421*b* to the score display part 500 in the same manner as described above.

At this time, the score display parts 500 may be divided into a basic score display part 501 configured to display a score of the basic score hole 421*a* and a bonus score display part 502 configured to display a score of the bonus hole 421*b*.

Meanwhile, when the ball B that has moved downward along the downward rail part 102 collides with a front surface between the goal-in holes 421 of the rotary plate 420, the ball B moves to the left and right on the ball guide frame 412 of the housing 410 and then is located at the central portion of the lower end of the housing 410, and at this time, the ball B enters the goal-in hole 421 that is rotated due to the rotary plate 420 and coincides with the tip of the downward rail part 102 for a predetermined amount of time among the plurality of goal-in holes 421 of the rotary plate 420 that are continuously rotated.

Then, in the same manner as described above, as the ball B is moved into the return hole 411 by the rotary plate 420 and discharged through the return hole 411, a score corresponding to the goal-in hole 421 is displayed on the score display part 500.

On the other hand, when the ball B is hit by the hitter 202 using the lever 201 of the hitting device 200 to move the ball B upward along the upward rail part 101, and at this time, the ball B moves downward along the upward rail part 101 and returns to its original position without reaching the downward rail part 102, the ball B is detected by the upward rail sensor 101*a*, but the ball B is not detected by the downward rail sensor 102*a*, it is determined that the game is currently being played.

In addition, when the ball B is hit by the hitter 202 using the lever 201 of the hitting device 200 to move the ball B upward along the upward rail part 101, and at this time, the ball B is not detected by either of the upward rail sensor 101*a* and the downward rail sensor 102*a*, the ball B is determined as having deviated from the upward rail part 101 and the downward rail part 102, and it is determined that a game error has occurred.

In addition, when the ball B is hit as described above, the ball B is sequentially detected by the upward rail sensor 101*a* and the downward rail sensor 102*a*, and then the ball B is detected by the ball detection sensor 440, it is determined that the game has ended normally, and then, the ball B is supplied to the upward rail part 101 through the ball supplier 300.

Next, when the game is played as described above, the scores of the score display parts 500 are summed up, and the number of tickets that can be output is displayed on the ticket output display part 105, and then, when the game ends, tickets are output, as many as the number of tickets displayed on the ticket output display part 105, through the ticket output part 104, and the tickets are obtained.

By the above-described structure in which the ball B hit by the hitting device 200 moves in a straight line along the upward rail part 101 and the downward rail part 102, the ball B enters any one of the goal-in holes 421 of the game score output part 400 that coincides with the downward rail part 102, and tickets are obtained as many as the number of tickets computed to correspond to a score corresponding to the goal-in hole 421 that the ball B has entered, a moving distance and a moving speed of the ball B can be easily adjusted by adjusting a hitting strength of the ball B using the lever 201 of the hitting device 200, a user can adjust the ball to enter a target goal-in hole 421 by adjusting the hitting strength of the ball B while checking a rotary position of the goal-in hole 421 of the game score output part 400, and a game can be played in various manners by calculating a goal-in position of the ball B while adjusting the rotary position of the goal-in hole 421 or the hitting strength of the ball B.

According to the present invention, there are advantages in that a moving distance and a moving speed of a ball can be easily adjusted by adjusting a ball hitting strength using a lever of a hitting device, a user can adjust the ball to enter a target goal-in hole by adjusting the ball hitting strength while checking a rotary position of the goal-in hole of a game score output part, a game can be played in various manners by calculating a goal-in position of the ball while adjusting the rotary position of the goal-in hole or the ball hitting strength, a level of interest in the game is increased due to the game being able to be played in various manners, competitive spirit is increased in relation to game scores due to a manner in which various scores are obtained by the ball entering goal-in holes that output different scores, and in particular, there is no limitation for the elderly or children, who have weak muscular strength, to enjoy the game because the ball hitting strength can be adjusted by operating the hitting device, and accordingly, the product reliability is improved.

The ball goal-in game machine according to the present invention that has been described above is not limited to the above-described embodiments. Various modifications may be made by those of ordinary skill in the art to which the present invention pertains without departing from the gist of the present invention claimed in the appended claims, and such modifications also belong to the technical spirit of the present invention.

What is claimed is:

1. A ball goal-in game machine comprising:

a game machine main body (100) having an upper surface on which an upward rail part (101) inclined at a predetermined angle from a front toward a rear and a downward rail part (102) extending to be inclined downward from a tip of the upward rail part (101) are formed to guide a ball (B) to move in a straight line along the upward rail part (101) and the downward rail part (102);

a hitting device (200) including a lever (201), which is installed to be able to move forward and backward, formed on a front surface of the game machine main body (100) and a hitter (202) connected to the lever (201), located at a front end of the upward rail part (101) of the game machine main body (100), connected to the lever (201) via a link structure, and moved forward and backward by the lever (201) to hit the ball (B);

a ball supplier (300) installed to be buried in an upper surface of the game machine main body (100) to be close to the upward rail part (101), moved upward or downward to be exposed to the upper surface of the game machine main body (100), and configured to supply the ball (B) to the upward rail part (101);

a game score output part (400) rotatably installed on a rear surface of the game machine main body (100) and having a plurality of goal-in holes (421) formed to be spaced apart at predetermined intervals in an annular shape along an edge to allow the ball (B) moving downward along the downward rail part (102) to enter one of the goal-in holes (421) and output different scores according to the goal-in hole (421) that the ball (B) has entered; and a plurality of score display parts (500) installed to be fixed to the rear surface of the game machine main body (100) to be located at an upper portion of the game score output part (400) and connected to the game score output part (400) to display a score corresponding to the goal-in hole (421) that the ball (B) has entered.

2. The ball goal-in game machine of claim 1, wherein the game machine main body (100) further includes:

a payment part (103) installed at one side of the front surface to allow a game play fee to be paid;

a ticket output part (104) installed at the other side of the front surface to allow a ticket to be output; and a ticket output display part (105) formed at one side of the upper surface and configured to compute the scores displayed on the score display parts (500) and display the number of tickets that are able to be output.

3. The ball goal-in game machine of claim 1, wherein the game machine main body (100) further includes:

an upward rail sensor (101*a*) installed on an upper surface of the front end of the upward rail part (101) to detect whether the ball (B) passes, output a sound effect through a speaker (100*a*), and detect whether the ball (B) enters the upward rail part (101); and a downward rail sensor (102*a*) installed on an upper surface of the downward rail part (102) to detect whether the ball (B) passes the downward rail part (102).

4. The ball goal-in game machine of claim 1, wherein the ball supplier (300) includes:

an upward/downward mover (310) having a rack gear (311) formed to stand upright on one side surface and a discharge hole (312), which is open toward the upward rail part (101), formed in a side surface orthogonal to the rack gear (311) and configured to move upward or downward to be exposed to the upper surface of the game machine main body (100) and drop and supply the ball (B) to the upward rail part (101); and a driving motor (320) buried in the upper surface of the game machine main body (100), provided at one side of the upward/downward mover (310), and having a pinion gear (321) formed to be engaged with and coupled to the rack gear (311) to rotate the pinion gear (321) in place and force the rack gear (311) to move upward or downward in a direction in which it stands upright.

5. The ball goal-in game machine of claim 4, wherein the upward/downward mover (310) further has an inclined bottom surface (312*a*) formed to be inclined downward from a bottom surface of the discharge hole (312) toward the upward rail part (101) to guide the ball (B) to roll down toward the upward rail part (101).

6. The ball goal-in game machine of claim 1, wherein the game score output part (400) includes:

a housing (410) formed in a hollow shape having an open front, formed to be inclined at a predetermined angle on the rear surface of the game machine main body (100) to correspond to a direction in which the ball (B) advances, and having a return hole (411) formed in a front surface on a rotation path of the goal-in hole (421) to coincide with the goal-in hole (421) and guide discharge of the ball (B) that has entered the goal-in hole (421);

a rotary plate (420) rotatably installed on an inner front surface of the housing (410) and having the plurality of goal-in holes (421), which are configured to coincide with the return hole (411), formed along an edge of a front surface and a rotating shaft (422) formed on a rear surface to be exposed to a rear of the housing (410);

an encoder (430) connected to a tip of the rotating shaft (422) of the rotary plate (420) and configured to rotate to correspond to the rotary plate (420) and identify a position of each of the goal-in holes (421);

a ball detection sensor (440) installed to be fixed around an edge of a rear surface of the return hole (411) of the housing (410) and configured to detect whether the ball (B) is discharged through the return hole (411);

a rotary motor (450) installed to be fixed to a rear surface of the housing (410) and configured to be coupled to be engaged with the rotating shaft (422) and rotate the rotary plate (420) in a forward direction or a reverse direction; and a controller (460) electrically connected to the encoder (430) and the ball detection sensor (440) and configured to receive signals from the encoder (430) and the ball detection sensor (440) and output a score of the ball (B), which has entered the goal-in hole (421), on the score display part (500).

7. The ball goal-in game machine of claim 6, wherein:

the housing (410) further has a ball guide frame (412) formed in an arch shape on an inner peripheral surface of a lower end to guide the ball (B), which has entered the housing (410), to be located at a central portion of the lower end of the housing (410); and the goal-in holes (421) of the rotary plate (420) further include basic score holes (421*a*) configured to allow entry of the ball (B) by a lower end contact point (P), among contact points differentiated in an up-down direction and a left-right direction by virtual orthogonal lines, being formed relatively lower than a height of an upper end of the ball guide frame (412) and bonus holes (421*b*) that are formed to be relatively less in number than the basic score holes (421*a*), formed to have different diameters, and configured to allow entry of the ball (B) by a lower end contact point (P), among contact points differentiated in the up-down direction and the left-right direction by virtual orthogonal lines, being formed relatively higher than the height of the upper end of the ball guide frame (412).

8. The ball goal-in game machine of claim 6, wherein the controller (460) receives a detection signal of the ball (B) from the ball detection sensor (440), also receives a position signal of the goal-in hole (421) coinciding with the return hole (411) among the plurality of goal-in holes (421) from the encoder (430), and outputs a score that corresponds to the goal-in hole (421) coinciding with the return hole (411) among the plurality of goal-in holes (421) to the score display part (500).

* * * * *